United States Patent [19]

Kircher

[11] 4,339,321

[45] Jul. 13, 1982

[54] METHOD AND APPARATUS OF INJECTING REPLENISHED ELECTROLYTE FLUID INTO AN ELECTROLYTIC CELL

[75] Inventor: Morton S. Kircher, Clearwater, Fla.

[73] Assignee: Olin Corporation, New Haven, Conn.

[21] Appl. No.: 213,801

[22] Filed: Dec. 8, 1980

[51] Int. Cl.[3] ..... C25B 9/00

[52] U.S. Cl. ..... 204/237; 204/257; 204/258

[58] Field of Search ..... 204/98, 128, 253–258, 204/263, 266, 237

[56] References Cited

U.S. PATENT DOCUMENTS

| | | | |
|---|---|---|---|
| 3,855,091 | 12/1974 | Piester | 204/128 |
| 3,898,149 | 8/1975 | Kircher et al. | 204/252 |
| 3,928,150 | 12/1975 | Rahn et al. | 204/98 |
| 3,928,165 | 12/1975 | Piester | 204/278 |
| 4,076,603 | 2/1978 | Andersen | 204/98 |
| 4,138,295 | 2/1979 | DeNora et al. | 204/98 |
| 4,149,952 | 4/1979 | Sato et al. | 204/258 |
| 4,174,266 | 11/1979 | Jeffery | 204/98 |
| 4,212,714 | 7/1980 | Coker et al. | 204/98 |
| 4,217,199 | 8/1980 | Cunningham | 204/256 |

*Primary Examiner*—R. L. Andrews

*Attorney, Agent, or Firm*—Ralph D'Alessandro; Donald F. Clements; Thomas P. O'Day

[57] ABSTRACT

In a filter press membrane chloralkali electrolytic cell having a plurality of electrodes with an external anolyte gas-liquid disengager in fluid flow communication with each anode via conduit means having a first predetermined cross-sectional area utilized to recirculate electrolyte from the disengager to each anode and electrolyte replenisher means connected to the disengager and each anode, there is provided an improved electrolyte recirculation system wherein the electrolyte replenisher means includes a plurality of feed pipes which are inserted individually within the conduit means thereby causing each feed pipe to be in fluid flow communication with each anode, each feed pipe further extending a predetermined distance into the conduit means from within the disengager and having a second predetermined cross-sectional area such that the outlet of flow of replenishing electrolyte is into the flow of recirculated electrolyte within the conduit means to effect maximum mixing of the fluids prior to entering each anode.

22 Claims, 4 Drawing Figures

METHOD AND APPARATUS OF INJECTING REPLENISHED ELECTROLYTE FLUID INTO AN ELECTROLYTIC CELL

BACKGROUND OF THE INVENTION

The present invention relates generally to the system utilized to recirculate electrolyte from the external gas-liquid disengagers to the appropriate electrode frames within an electrochemical cell. More specifically, the present invention relates to an improved recirculation system that connects the appropriate fluid replenisher in the external disengager to each individual electrode frame in a manner which promotes thorough mixing of the recycled and replenished fluids and allows for a controlled concentration gradient through the electrolyte internal circulation loop, as well as minimizing the leakage of electricity in the electrical circuit to ground.

Chlorine and caustic, products of the electrolytic process, are basic chemicals which have become large volume commodities in the industrialized world today. The overwhelming amounts of these chemicals are produced electrolytically from aqueous solutions of alkali metal chlorides. Cells which have traditionally produced these chemicals have come to be known as chloralkali cells. The chloralkali cells today are generally of two principal types, the deposited asbestos diaphragm-type electrolytic cell or the flowing mercury cathode-type. Comparatively recent technological advances, such as the development of the dimensionally stable anodes and various coating compositions, have permitted the gap between electrodes to be substantially decreased. This has dramatically increased energy efficiency during the operation of these energy-intensive units.

The development of a hydraulically impermeable membrane has promoted the advent of filter press membrane chloralkali cells which produce a relatively uncontaminated caustic product. This higher purity product obviates the need for caustic purification and concentration processing. The use of a hydraulically impermeable planar membrane has been most common in bipolar filter press membrane electrolytic cells. However, advances continue to be made in the development of monopolar filter press membrane cells.

Replenishing the depleted fluids within the anodes and cathodes has been accomplished in prior art structures simply by having external feed lines carry replenished fluids into the electrodes. These feed lines normally replenish the depleted fluids with fresh fluids by having the external feed lines feed into the top of the appropriate electrode or, in the case of the diaphragm-type cell, into the top of the electrolyte holding vessel.

Prior art structures have also replenished depleted fluids by using internal feed lines. These feed lines replenish the fluids, either deionized water in the case of the cathode or salt brine in the case of the anode, by either utilizing the existing electrode frame side channels to carry the fresh electrolyte towards the bottom of the electrode or feeding the electrolyte into the electrode from the top through short feed lines. An alternative approach is to direct replenished brine into a funnel-type structure connected to a pipe, and then allow the replenished brine to flow to the bottom of the electrolyte holding vessel where the concentrated replenished brine is allowed to mix with existing electrolyte.

All of these methods fail to mix the fresh electrolyte thoroughly with the existing electrolyte in the individual electrodes which are in the electrode holding vessel. These prior art methods fail to provide thorough mixing of the fresh electrolyte with the existing electrolyte before the fresh electrolyte contacts the cell membrane. These methods also fail to provide staged, gradual concentration changes in the electrolyte as it passes through the area or zone of the cell where electrolysis occurs. Lastly, none of the methods provide adequate resistance to the leakage of electrical current to ground. In filter press membrane chloralkali cells this failure to thoroughly mix the electrolyte fluid prior to its entering the individual electrode is even more critical. The nature of the membranes is such that the membranes expand or swell as they absorb the deionized water which is fed into the cathodes from catholyte feed lines. The membranes can also shrink if there is a high concentration of electrolyte, such as salt brine, which tends to dehydrate the membrane. In instances where there is not a thorough mixing of the fresh electrolyte with the depleted electrolyte, the concentration level of electrolyte will vary at different locations throughout the cell. The more concentrated electrolyte tends to dehydrate the membrane in those areas where it is in contact with the membrane. This dehydration tends to shrink the membrane at this point. Such differential swelling and shrinking of the filter press membrane presents operational problems which decrease the operating efficiency of the entire cell.

There is another problem peculiar to filter press membrane chloralkali cells which is created by the addition of fresh brine or other electrolyte chemicals directly into the electrode. The specific problem arises in the anodes of cells employing such a system where the direct addition of these chemicals into the anodes can cause the chemicals to locally attack the membrane. The reaction of the chemicals with the membrane reduces the operating life span of the membrane and generally adversely affects the efficiency of the system.

None of the prior art methods of recirculating and replenishing the cell fluids optimize cell efficiency. Frequently, the methods employed cause excessive dilution of the caustic in the cathodes upon the addition of deionized water. Dilution of the caustic normally occurs where the deionized water is added to the system prior to the withdrawal of the caustic product.

A continuing problem with filter press membrane electrolytic chloralkali cells has been the loss of electrical current due to leakage of electricity to ground. This obviously reduces the overall efficiency of the individual cell.

Additionally, excessive corrosion of the metal feed nozzles within the cell also decreases the energy effectiveness of each unit. More significantly, however, corrosion of the metal parts within the cell may cause fluid leakage, structural damage or plugging of the electrolyte along its path of flow. This corrosion is accelerated by the high electric potential which typically is found in the affected components and can cause extensive outages or repairs.

Attempts to reduce the amount of electrical current leakage to ground led to the use of orifices and other devices in the brine feed line to break the electrically conductive stream of salt brine into droplets prior to its being fed into the cell. These droplets prevent current from traveling up through the electrolyte and out of the cell via the brine feed apparatus. This dropletting of brine has been called the "breaker effect". Such devices have been found effective for smaller electrolyte flows. However, in the large scale commercial production equipment employed today, these devices and others proposed for this purpose are unsatisfactory, frequently proving troublesome and hindering the efficient operation of the cell. Exemplary of the problems encountered in creating this breaker effect is the tendency of orifices and other such devices to become ineffective due to flooding and the increased maintenance that is required because of the larger sized equipment employed. Also, the requirement for large volume capacity equipment in the large sized commercial facilities utilized today has caused the efficient operating potential of such devices to be exceeded.

The foregoing problems are solved in the design of the apparatus comprising the present invention.

SUMMARY OF THE INVENTION

It is a principal object of the present invention to provide in a filter press membrane chloralkali electrolytic cell an improved recirculation system within the cell which feeds brine and deionized water into turbulent electrolytic recycle streams so that both the brine and the deionized water are thoroughly mixed prior to coming into contact with the membrane, thereby avoiding differential swelling and shrinking of the membrane.

It is another object of the present invention to provide an improved recirculation system which adds concentrated salt brine into each anode in a manner to permit a slight concentration gradient in the electrolyte therein to thereby increase voltage and current efficiency.

It is another object of the present invention to provide an improved recirculation system which adds deionized water into each cathode in a manner to permit a slight concentration gradient in the electrolyte fluid therein to thereby increase the voltage and current efficiency.

It is another object of the present invention that there is provided an improved recirculation system within each electrode compartment that achieves a greater uniformity of concentration of fluid within each electrode.

It is a further object of the present invention to provide an improved recirculation system which decreases the amount of electrical current lost to ground during operation and, hence, to reduce damage due to electrolytic corrosion.

It is a feature of the present invention that the improved recirculation system utilizes a plurality of small feed lines within the appropriate gas-liquid disengager to inject fresh feed brine and deionized water into turbulent recycle streams prior to the fresh feed fluids contacting the membranes separating the anodes and cathodes and which define the boundaries of their respective electrolytic compartments.

It is another feature of the present invention that each small feed tube is inserted within a larger conduit that is in fluid flow communication with the appropriate gas-liquid disengager and the corresponding individual electrodes.

It is a further feature of the present invention that each feed pipe has a cross-sectional area that is substantially less than the cross-sectional area of the conduit within which it is inserted which connects the appropriate gas-liquid disengager and the electrode.

It is an advantage of the present invention that the improved recirculation system prevents the mixing of feed brine and feed water with effluent and provides increased resistance to the leakage of electrical current to ground.

It is another advantage of the present invention that the small feed pipes used to inject the feed brine and deionized water into the appropriate electrodes extend sufficiently far into the corresponding conduit to reduce the electrical potential at the inlets and outlets of the recirculation system such that the potential is reduced to a level below that at which electrochemical corrosion will occur for metals utilized at the inlets and outlets of the cell.

It is a further advantage of the improved recirculation system that the individual feed pipes into each electrode promote more uniform mixing of the fluids so that there is greater uniformity in the concentration of fluids within all the electrodes.

These and other objects, features and advantages are obtained in a filter press membrane chloralkali electrolytic cell by providing an improved electrolyte recirculation system wherein the salt brine and deionized water replenishers are connected to a plurality of feed pipes which are inserted individually within the conduit means connecting each external gas-liquid disengager to the appropriate electrode to cause each feed pipe to be in fluid flow communication with each individual electrode, each feed pipe further extending a predetermined distance into the conduit and having a predetermined cross-sectional area that is substantially less than the cross-sectional area of the conduit such that the outlet of flow of the replenished fluid is into the flow of recirculated fluid within the conduit means to effect maximum mixing of the fluids prior to entering the individual electrode compartment and to reduce the leakage of electrical current to ground.

BRIEF DESCRIPTION OF THE DRAWINGS

The advantages of this invention will become apparent upon consideration of the following detailed disclosure of the invention, especially when it is taken in conjunction with the accompanying drawings wherein.

DETAILED DESCRIPTION OF THE PREFERRED EMBODIMENT

Figure 1:
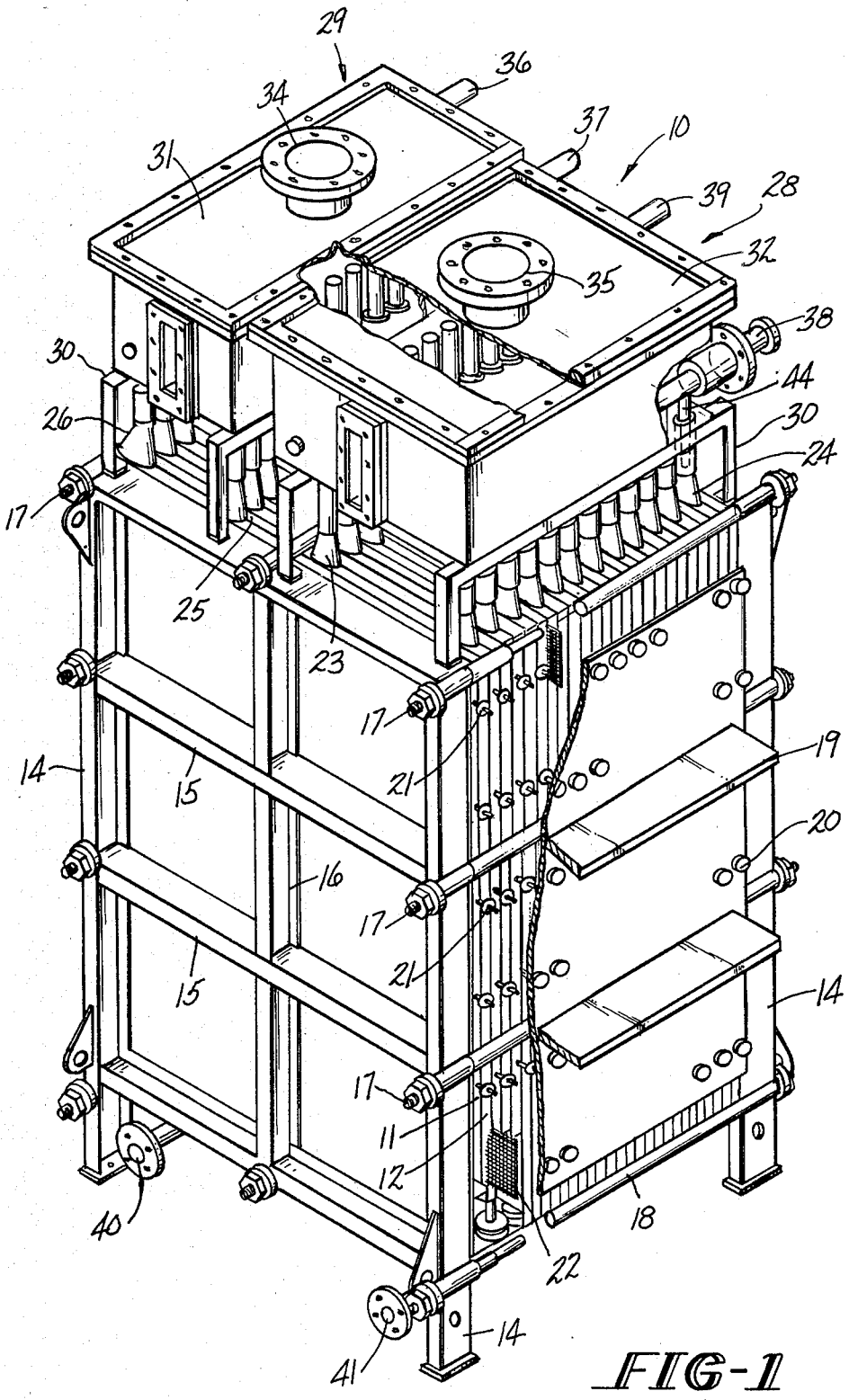
FIG. 1 is a side perspective view of a monopolar filter press membrane chloralkali electrolytic cell with appropriate portions broken away to illustrate the anodes, cathodes and the anolyte and catholyte gas-liquid disengagers.

Referring to FIG. 1, a filter press membrane cell, indicated generally by the numeral 10, is shown in a side perspective view. It can be seen that cathodes 11 and anodes 12 alternate and are oriented generally vertically. The cathodes 11 and anodes 12 are supported by vertical side frame members 14, horizontal side frame members 15, and intermediate vertical side frame members 16 (only one of which is shown). The cathodes 11 and anodes 12 are pressed together and secured by a series of tie bolts 17 which are inserted through appropriate mounting means affixed to the vertical side frame members 14. To prevent short circuiting between the electrodes during the electrolytic process, the tie bolts 17 have tie bolt insulators 18 through which the tie bolts 17 are passed in the area of the cathodes 11 and anodes 12.

Figure 2:
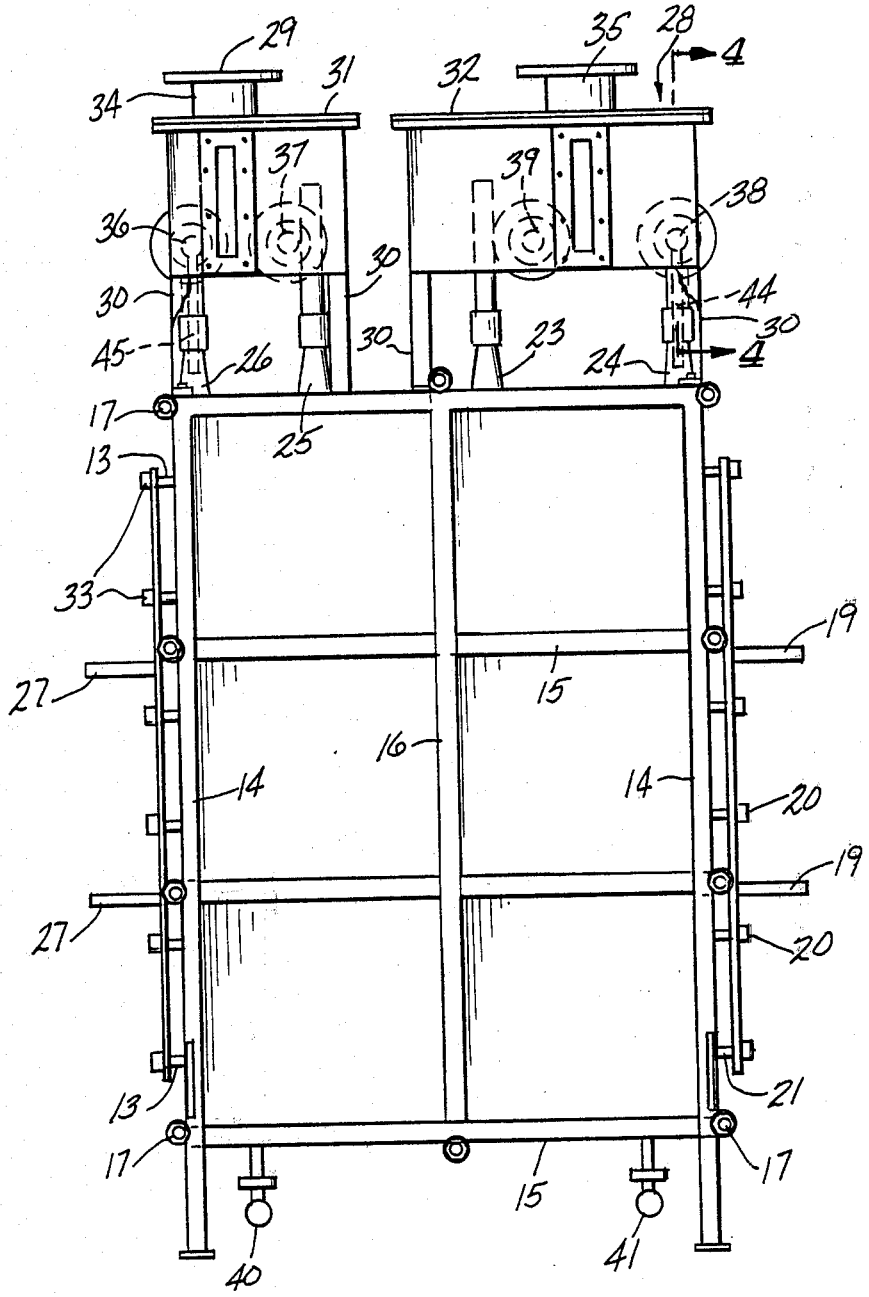
FIG. 2 is a side elevational view of a monopolar filter press membrane chloroalkali electrolytic cell showing the cell supporting frame and the anolyte and catholyte gas-liquid disengagers with appropriate conduit means which connect the disengagers to each electrode.

Electrical current is passed, for example, from an external power source through the anode bus 27 and then via anode bus nuts 33 into the anode conductor rods 13. From that point, the conductor rods 13 pass the current into the anode surfaces 42 (see FIG. 3 briefly). The current continues flowing through the membrane 22, through the opposing cathode surfaces (not shown), the cathode conductor rods 21 and cathode bus nuts 20 to the cathode bus 19 where it continues its path out of the cell. The anodic conducting means are present on the opposing side of the filter press membrane cell from the cathodic conducting means just described and are best seen in FIG. 2. Ion-selective permeable membranes 22 are diagramatically shown in FIG. 1 to illustrate how each anode 12 and cathode 11 are separated by the membrane.

Projecting from the top of anode 12 and cathode 11 are a series of fluid flow conduits. FIGS. 1 and 2 show anode risers 23 and anode downcomers or anolyte return lines 24 projecting from the top of each anode 12. Similarly, cathode riser 25 and cathode downcomer or catholyte return line 26 is shown projecting from the top of each cathode 11. The risers are generally utilized to carry the appropriate electrolyte fluid with the accompanying gas, either anolyte with chlorine gas or catholyte with hydrogen gas, to the appropriate disengager mounted atop the filter press membrane cell 10. The anolyte disengager is indicated generally by the numeral 28, while the catholyte disengager is indicated generally by the numeral 29. Each disengater is supported atop of the cell 10 by disengager supports 30. It is in each of these disengagers that the gas is enabled to separate from the liquid of the anolyte or catholyte fluid, as appropriate, and is released from the appropriate disengager via either a cathode gas release pipe 34 or an anode gas release pipe 35 affixed to the appropriate catholyte disengager cover 31 or anolyte disengager cover 32.

Also partially illustrated in FIGS. 1 and 2 is the catholyte replenisher conduit 36 which carries deionized water into the catholyte disengager 29. The deionized water is appropriately fed through the catholyte disengager 29 to each cathode 11 in cell 10. A catholyte outlet pipe 37 is also partially illustrated and serves to control the level of liquid in the catholyte disengager 37 by removing caustic to its appropriate processing apparatus.

An anolyte replenisher conduit 38 carries fresh brine into the anolyte disengager 28 and is best seen in FIGS. 1 and 2. The fresh brine is then appropriately fed into each anode 12 with the existing anolyte fluid which is recirculated from the anolyte disengager 28 into each anode 12 via the downcomers 24. An anolyte outlet pipe 39 is also shown and serves to control the level of liquid in the anolyte fluid within the anolyte disengager 28 by removing the spent brine for regeneration.

Also shown in FIGS. 1 and 2 are a cathodic bottom manifold 40 and an anodic bottom manifold 41, which are utilized to drain the appropriate electrode.

The filter press membrane cell 10 has been described only generally since the structure and the function of its central components are well known to one of skill in the art. A more detailed and thorough description of the filter press membrane cell 10 is found in U.S. patent application Ser. No. 128,684, filed March 10, 1980, and assigned to the assignee of the present invention. This application is herein specifically incorporated by reference in pertinent part insofar as it is consistent with the instant disclosure.

Referring again to FIG. 2, it can be seen that the catholyte replenisher conduit 36 and the anolyte replenisher conduit 38 are connected to a plurality of catholyte feed pipes 45 and anolyte feed pipes 44, respectively (only one of each of which is shown in FIG. 2). The anolyte feed pipes 44 and catholyte feed pipes 45 extend downwardly from their respective replenisher conduits 38 and 36, into the appropriate anode downcomers or conduit means 24 or cathode downcomers or conduit means 26. It is seen that the anode downcomers 24 and the cathode downcomers 26 extend from within their appropriate electrodes upwardly into the anolyte disengager 28 or the catholyte disengager 29, as appropriate. This enables the appropriate fluid, which is carried upwardly into the appropriate disengager by the anode riser 23 or the cathode riser 25, to be circulated through the appropriate disengager and recycled downwardly into the appropriate electrodes. However, since the deionized water utilized in the cathodes must be replenished and the brine in the anodes must also be replenished, catholyte replenisher conduit 36 and anolyte replenisher conduit 38 are provided within the cell 10. Thus, the deionized water flows from the catholyte replenisher conduit 36 through catholyte feed pipes 45 into each cathode via the cathode downcomers 26. Similarly, the fresh brine flows from the anolyte replenisher conduit 38 through anolyte feed pipes 44 into each anode via the anode downcomers 24.

Figure 3:
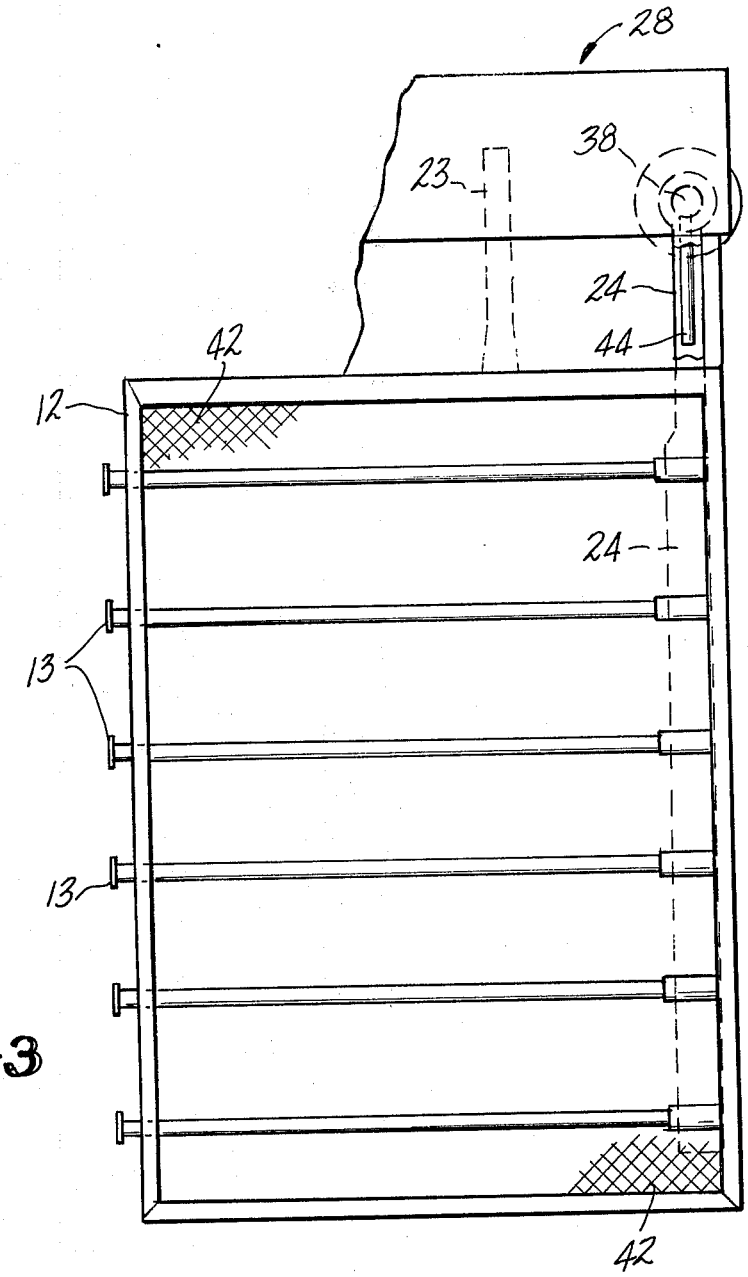
FIG. 3 is a side elevational view of an individual anode with a portion of the anolyte disengager and the electrode surface broken away to show the electrolyte feed line within the conduit connecting the anolyte disengager to the anode.
Figure 4:
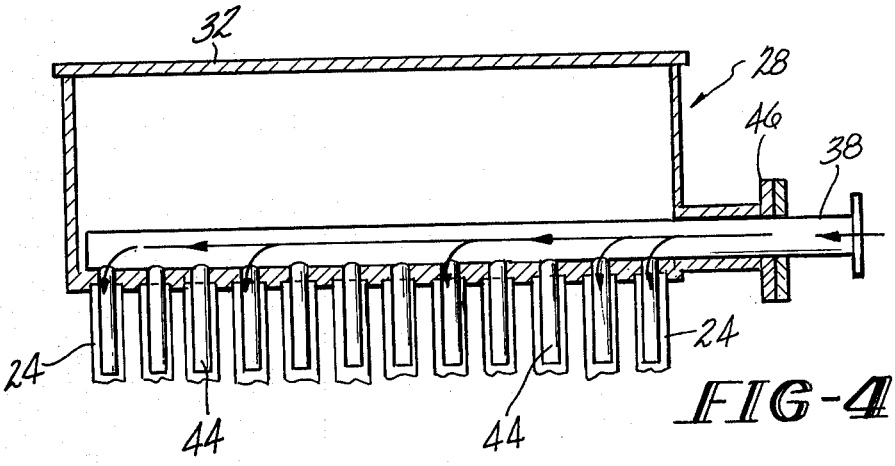
FIG. 4 is an enlarged side elevational view of an anolyte gas-liquid disengager taken along the lines 4—4 of FIG. 2 showing the electrolyte replenisher manifold and the individual feed lines connected thereto which insert within the conduits which connect the disengager to the individual anodes.

FIGS. 3 and 4 further illustrate a typical utilization of the feed pipes within the appropriate disengager. FIG. 3 shows an anolyte feed pipe 44 being utilized with an anode 12 and the anolyte disengager 28. FIG. 4 further illustrates how the anolyte replenisher conduit 38 is connected via the plurality of anolyte feed pipes 44 with the anolyte downcomers 24 to provide replenished brine to each anode 12. The anolyte replenisher conduit 38 has an anolyte replenisher conduit support flange 46 fastened to the anolyte disengager 28 and the anolyte replenisher conduit 30 to provide it additional support. FIGS. 3 and 4 also further illustrate how the anolyte feed pipes 44 extend a predetermined distance down into the anode downcomers 24 to release the stream of replenished or concentrated brine into the recirculated electrolyte moving downwardly from the anolyte disengager 28 into each anode 12.

It is this release of the stream of concentrated brine into the recirculated electrolyte at this point within the recirculation system that effects the thorough mixing of the replenished brine and electrolyte prior to the liquids entering the individual anodes 12. Since this thorough mixing occurs prior to entering the anodes 12, the liquids are thoroughly mixed prior to having any contact with the membranes 22 which separate each anode 12 and cathode 11 to avoid differential swelling and shrinking of the membranes due to varying brine concentration levels within each anode. FIG. 3 further shows one of the anode opposing surfaces 42 which are appropriately affixed to the anode 12. It is these anode opposing surfaces 42 on each anode 12 which combine with the hydraulically impermeable membranes 22 to form an electrolytic compartment through which only selected ions will pass.

The intermediate cell cathodes 11 also have opposing surfaces (not shown) which are appropriately affixed to the cathodes. The two end cathodes (not shown) have only a single electrode surface. Both the anode opposing surfaces 42 and the cathode opposing surfaces (not shown) are foraminous. However, the hydraulically impermeable membranes 22 separate each anode 12 and cathode 11 and via this impermeability serve to preserve the anolyte and catholyte liquid integrity between the electrodes and the adjacent electrolytic compartment.

While an individual cathode 11 with its catholyte feed pipes 45 and catholyte disengager 29 are not shown specifically, it should be understood that their structure would be substantially the same as that shown in FIGS. 3 and 4 wherein the anolyte feed pipes 44, anolyte disengager 28, and anode 12 are illustrated.

The catholyte replenisher conduit 36 and the anolyte replenisher conduit 38 typically are two inches in diameter with their respective feed pipes extending downwardly therefrom. The feed pipes are typically one half inch in diameter and extend from about 4 to 9 inches down into the anode downcomer 24 or cathode downcomer 26, as appropriate. However, the preferred dimensions would utilize one quarter inch diameter feed pipes which extend from about 9 inches to about 6 feet down into the anode downcomer 24 or cathode downcomer 26, as appropriate. The anolyte replenisher conduit 38 and feed pipes 44 are typically constructed of Polyvinylidene Chloride (PVDC), Chlorinated Polyvinyl Chloride (CPVC), Polyfluorotetraethylene (Teflon ®), or other corrision resistant materials, while the catholyte replenisher conduit 36 and the catholyte feed pipes 45 are made of CPVC or other appropriate material. Non-metallic material is normally preferred for the construction of the feed pipes. However, suitable metal may be used where circuit voltage is not a problem, such as nickel in the catholyte replenisher conduit 36 and catholyte feed pipes 45 and titanium in anolyte replenisher conduit 38 and anolyte feed pipes 44.

The diameters of the anolyte feed pipes 44 and the catholyte feed pipes 45 are determined by the friction head loss so as to provide a uniform head loss of a few pounds per square inch since such relatively high head loss improves distribution of the replenishing liquid in the cell 10. This level of head loss also serves to minimize electrical current leakage within the cell and improves the mixing of recycled brine or caustic with the fresh brine or deionized water, as appropriate, by creating a high velocity in the liquid flowing from the appropriate feed pipes at the point of exit into the appropriate anode downcomers or conduit means 24 or cathode downcomers or conduit means 26. The diametric dimensions of the catholyte replenisher conduit 36, the anolyte replenisher conduit 38, the catholyte outlet pipe 37, and the anolyte outlet pipe 39 are determined by the friction head loss so as to provide a uniform head loss of only a few inches of water.

The ratio of feed to recycled liquids may range from about 1:10,000 or from about 1:0.5 depending upon the feed additive and the specific purpose. In particular, for feed brine it is desired to have a ratio of feed to recycled liquid ranging from about 1:5 to about 1:100. The preferable range is from about 1:10 to about 1:50. These ratios of feed to recycled brine or deionized water are obtained by having cross-sectional areas within the anolyte feed pipes 44 and catholyte feed pipes 45 and cross-sectional areas within the anolyte and catholyte downcomers or conduit means 24 and 25, respectively, which range from about 1:4 to 1:1000.

Because the feed brine, especially, is injected into the anode downcomer 24 from the anolyte replenisher conduit 38 via the anolyte feed pipes 44 in small streams over a path extending from only several inches to several feet in length, there is sufficient electrical resistance to prevent the loss of electrical energy from the cell 10 via leakage to ground. Also, since feed brine is added to the anode 12 after the withdrawal of anolyte from the anolyte disengager 28 through the anolyte outlet pipe 39, a more concentrated brine is introduced into each anode 12. This concentrated brine tends to increase voltage efficiency and current efficiency, or to reduce the amount of brine feed required, or a combination of both. In the catholyte disengager 29, the deionized feed water is added via the catholyte replenisher conduit 36 after the withdrawal of the caustic product via the catholyte outlet pipe 37. This produces a more concentrated caustic than if the deionized water is introduced prior to the withdrawal of the caustic product or conversely, permits electrolyte of a slightly lower concentration than the concentration of the caustic product to be introduced into each cathode.

The addition of feed to the circulating electrolyte is made after withdrawal of the effluent stream from the disengagers. In the anolyte circulation cycle this permits a gradient of brine concentration to be established between the point of feed and the discharge. The brine feed concentration is higher directly subsequent to the feed addition from the anolyte feed pipes 44 into the anode downcomers 24. This concentration then decreases slightly, but significantly to a lower concentration at the point of discharge from the downcomers 24 into each anode 12. The concentration decreases further as the electrolyte rises from the bottom of the anode 12 up through the anode and into the anolyte disengager 28 through the riser 23. The most dilute electrolyte or brine is found in the anolyte outlet pipe 39 where the brine is carried away from the disengager 28. In the catholyte circulation cycle, the caustic concentration is lowest, and, therefore, the optimum for highest current efficiency, directly subsequent to the deionized water feed addition from the catholyte feed pipes 45 into the cathode downcomers 26. The caustic concentration increases slightly, but significantly at the point of discharge from the cathode downcomers 25 into each cathode 11. The caustic increases in concentration as it rises upwardly within the cathode 11 and passes through the riser 25 into the catholyte disengager 29. The most concentrated caustic is carried from the catholyte disengager 29 via the catholyte outlet pipe 37.

Finally, since each individual cathode 11 and anode 12 receives feed in the recirculation system via their anolyte feed pipes 44 and catholyte feed pipes 45, a greater uniformity of concentration among the cathodes 11 and anodes 12 is obtained.

In operation, a filter press membrane cell 10 has an electric current from an external power source conducted via an anode bus 27, anode bus bolts 33 and anode conductor rods 13 into each anode 12. Similarly, electrical current is conducted via the cathode bus 19, the cathode bus bolts 20 and the cathode conductor rods 21 into each cathode 11. Electrolyte fluid, principally a salt brine, is fed from the anolyte replenisher conduit 38 via the anolyte feed pipes 44 into each anode 12. A fluid for feeding the catholyte fluids such as deionized water, is fed through the catholyte replenisher conduit 36 via the catholyte feed pipes 45 into each cathode 11. The catholyte fluid with the mixed deionized water is fed down through the catholyte downcomer 26 into each cathode 11.

The electrolytic process within the cell causes the freeing of chlorine from the salt brine and hydrogen from the deionized water. The chlorine rises as a gas with the anolyte fluid through the anolyte risers 23 into the anolyte disengager 28. Within the disengager 28, the chlorine gas is permitted to separate from the anolyte fluid and leaves the disengager 28 via the anode gas release pipe 35 enroute to appropriate gas processing apparatus. In the cathodes 11, the hydrogen gas moves with the catholyte fluid, including the appropriate caustic, upwardly through the cathode riser 25 into the catholyte disengager 29. The hydrogen gas is separated from the catholyte fluid and leaves the disengager via the cathode gas release pipe 34 which is connected to appropriate gas processing apparatus. The caustic is removed for appropriate processing via the catholyte outlet pipe 37. The brine and the deionized water are replenished in each electrode via the aforementioned catholyte replenisher conduit 36 and anolyte replenisher conduit 38, respectively. The injection of these replenished fluids into their appropriate downcomers in long, thin streams promotes thorough mixing of the brine with the recycled anolyte fluid and deionized water with the recycled catholyte fluid prior to the entry of the anolyte fluid and the catholyte fluid into the anodes 12 and cathodes 11, respectively.

It should also be noted that the brine could be replenished in the anodes 12 through an anolyte replenisher conduit 38 which connects via anolyte feed pipes 44 to the anode downcomers 24 externally of the anolyte disengager 28. Similarly, the deionized water could be added to the cathodes 11 through catholyte replenisher conduit 36 which connects via catholyte feed pipes 45 to the catholyte downcomers 26 externally of the catholyte disengager 29.

While the preferred structure in which the principles of the present invention have been incorporated is shown and described above, it is to be understood that the invention is not to be limited to the particular details thus presented, but in fact, widely different means may be employed in the practice of the broader aspects of this invention. For example, although the primary use for the invention disclosed herein is for lines feeding brine and make-up water, the same method and equipment are suitable for other additives, such as acid, recycled caustic, phosphate solutions, sulfide solutions and the like. The scope of the appended claims is intended to encompass all obvious changes in the details, materials and arrangement of parts which will occur to one of skill in the art upon a reading of the disclosure.

Having thus described the invention, what is claimed is:

1. A method of recirculating electrolyte within a filter press membrane chloralkali electrolytic cell having anolyte and catholyte disengagers in fluid flow communication with electrodes which comprises:

(a) recirculating electrolyte from the disengagers into each electrode in a flow stream along a first direction of flow; and (b) injecting fresh electrolyte from an electrolyte replenisher into the flow stream of recirculating electrolyte parallel to the first direction of flow before the stream enters the electrode to thereby effect thorough mixing of the fluids prior to the fluids entering each electrode.

2. The method according to claim 1 further comprising recirculating electrolyte from the anolyte disengager into each anode in a flow stream.

3. The method according to claim 2 further comprising injecting fresh electrolyte into the flow stream of recirculating electrolyte before the electrolyte enters the anode.

4. The method according to claim 1 further comprising injecting deionized water into the flow stream of recirculating electrolyte from the catholyte disengager before the stream enters the cathode to thereby effect thorough mixing of the fluids.

5. The method according to claim 1 wherein the first direction of flow is generally vertical.

6. In a filter press membrane chloralkali electrolytic cell containing electrolyte fluid connectable to a source of power utilized to energize the electrolytic reaction therein, the combination comprising:

(a) frame means to support the cell;

(b) a plurality of planar cathodes supported by the frame means, each cathode further having two opposing surfaces;

(c) a plurality of planar anodes supported by the frame means and connectable to the power source, each anode being sandwiched between a pair of cathodes and having two opposing surfaces;

(d) a plurality of planar hydraulically impermeable ion-selective membranes positioned between each anode and cathode to control the flow of ions and fluid thereacross;

(e) a catholyte disengager external to each cathode and in fluid flow communication therewith via catholyte conduit means for the separation of gas from the catholyte fluid contained therein;

(f) an anolyte disengager external to each anode and in fluid flow communication therewith at least partially supported by the frame for the separation of gas from the electrolyte fluid contained therein;

(g) anolyte conduit means having a first predetermined cross-sectional area utilized to recirculate electrolyte from the anolyte disengager to the anodes;

(h) catholyte conduit means having a second predetermined cross-sectional area utilized to recirculate fluids from the catholyte disengager to the cathodes;

(i) means within the anolyte disengager for replenishing electrolyte fluid to provide a flow of fresh electrolyte to the cell;

(j) a plurality of anolyte feed pipes extending from the means for replenishing the electrolyte fluid a predetermined distance into the anolyte conduit means having a third predetermined cross-sectional area substantially less than the first predetermined cross-sectional area such that the outlet of the flow of fresh electrolyte is into the flow of recirculated electrolyte within the anoltye conduit means to effect thorough mixing of the fluids prior to entering each anode and to decrease the leakage of current therethrough.

7. The apparatus according to claim 6 wherein the anolyte conduit means is at least partially circular in cross-section and extends from the anolyte disengager downwardly into each anode a predetermined distance.

8. The apparatus according to claim 7 wherein the anolyte feed pipes are circular in cross-section and extend within the anolyte conduit means a distance less than the distance from the anolyte disengager to each anode.

9. The apparatus according to claim 7 wherein the ratio of the third predetermined cross-sectional area to the first predetermined cross-sectional area ranges from about 1:4 to about 1:1000.

10. The apparatus according to claim 7 wherein the anolyte feed pipes extend within the anolyte conduit means for a distance ranging from about 9 inches to about 6 feet.

11. The apparatus according to claims 8 or 10 wherein the means for replenishing electrolyte fluid is within the anolyte disengager.

12. The apparatus according to claim 6 wherein the cell further includes means for replenishing the catholyte fluid within each cathode to supply a flow of fresh fluid thereto.

13. The apparatus according to claim 12 wherein the apparatus further includes a plurality of catholyte feed pipes extending from the means to replenish the catholyte fluid a predetermined distance into the catholyte conduit means, each catholyte feed pipe having a fourth predetermined cross-sectional area such that the outlet of the flow of fresh catholyte fluid is into the flow of recirculated fluids from the catholyte disengager to the cathodes within the catholyte conduit means to effect thorough mixing of the fluids prior to entering each cathode.

14. The apparatus according to claim 13 wherein the catholyte conduit means is at least partially circular in cross-section and extends from the catholyte disengager downwardly into each cathode a predetermined distance.

15. The apparatus according to claim 14 wherein the catholyte feed pipes are circular in cross-section and extend within the catholyte conduit means a distance less than the distance from the catholyte disengager to each cathode.

16. The apparatus according to claim 15 wherein the ratio of the fourth predetermined cross-sectional area to the second predetermined cross-sectional area ranges from about 1:4 to about 1:1000.

17. The apparatus according to claim 14 wherein the catholyte feed pipes extend within the catholyte conduit means a distance ranging from about 9 inches to about 6 feet.

18. The apparatus according to claims 14 or 17 wherein the means for replenishing the catholyte fluid is within the catholyte disengager.

19. In a filter press membrane cell for the production of chlorine and hydrogen gas and a caustic having a plurality of anodes of predetermined height with a top and a bottom connected to an electrical power source, an external anolyte disengager in fluid flow communication with each anode via conduit means having a first predetermined cross-sectional area utilized to recirculate electrolyte in a first flow direction from the disengager to a location adjacent the bottom of each anode, electrolyte replenisher means connected to the conduit means and each anode, the improvement comprising:

an improved electrolyte recirculation system wherein the electrolyte replenisher means is conneted to a plurality of feed pipes which are inserted individually within the conduit means thereby causing each feed pipe to be in fluid flow communication with an anode in a direction parallel to the first flow direction, each feed pipe further extending a predetermined distance into the conduit means from within the disengager and having a second predetermined cross-sectional area such that the outlet flow of replenishing electrolyte is paralled to and into the flow of recirculated electrolyte within the conduit means to effect through mixing of the fluids prior to entering the anode and to decrease the leakage of electrical current therethrough.

20. The apparatus according to claim 19 wherein the ratio of the second predetermined cross-sectional area to the first predetermined cross-sectional area ranges from about 1:4 to about 1:1000.

21. The apparatus according to claim 20 wherein the anolyte feed pipes extend within the conduit means for a distance ranging from about 9 inches to about 6 feet.

22. The apparatus according to claim 16 wherein the electrolyte replenisher means is within the anolyte disengager.

* * * * *